United States Patent [19]

Kobayashi et al.

[11] 4,058,675

[45] Nov. 15, 1977

[54] LOUDSPEAKER SYSTEM FOR USE IN A STEREOPHONIC SOUND REPRODUCTION SYSTEM

[75] Inventors: Fumio Kobayashi, Hino; Shozo Koshigoe, Sayama, both of Japan

[73] Assignee: Sansui Electric Co., Ltd., Japan

[21] Appl. No.: 696,218

[22] Filed: June 15, 1976

[30] Foreign Application Priority Data

June 19, 1975 Japan ..... 50-83940[U]

[51] Int. Cl.[2] ..... H04R 5/00; H04R 5/02; H04R 5/04

[52] U.S. Cl. ..... 179/1 G; 179/1 GA

[58] Field of Search ..... 179/1 AT, 1 P, 1 GQ, 179/1 E, 1 G, 1 GA, 1 GP

[56] References Cited

FOREIGN PATENT DOCUMENTS

| | | | |
|---|---|---|---|
| 844,169 | 7/1952 | Germany | 179/1 R |
| 2,350,835 | 4/1974 | Germany | 179/1 E |
| 198,004 | 6/1967 | U.S.S.R. | 179/1 P |

OTHER PUBLICATIONS

Head-Related Two-Channel Stereophony With Loudspeaker Reproduction, Journal of the Acoustical Society of America, P. Damaske, vol. 50, No. 4, pp. 1109-1115, Oct. 1971.

*Primary Examiner*—George G. Stellar
*Attorney, Agent, or Firm*—Harris, Kern, Wallen & Tinsley

[57] ABSTRACT

In order to improve characteristics of localization of sound images and a listener's sense of stereophonic perspective, a loudspeaker system for a stereophonic sound reproduction system comprises a main speaker adapted to be driven by audio input signal and radiate acoustic energies toward a listener for stereophonic reproduction, and a subspeaker adapted to be driven by the input signal and radiate out-of-phase acoustic energies which are smaller in magnitude than the acoustic energies provided by the main speaker and reach the listener with a time delay.

10 Claims, 17 Drawing Figures

LOUDSPEAKER SYSTEM FOR USE IN A STEREOPHONIC SOUND REPRODUCTION SYSTEM

BACKGROUND OF THE INVENTION

This invention relates to a loudspeaker system for use in a stereophonic reproduction system.

For a stereophonic reproduction, in general, a pair of speaker devices SL and SR are placed at equal distances from a listener P as shown in FIG. 1 and radiate stereophonic acoustic energies in response to application of left and right stereophonic signals L and R thereto.

It is usually said that for a continuous sound a human being senses the direction of a sound source by the sound pressure difference (mainly high frequencies) and phase difference (mainly low frequencies) of sounds reaching the right and left ears of a listener and that, for a pulsive sound, i.e., an instantaneous sound, the direction of the sound is sensed primarily dependent upon the time difference and amplitude difference between sounds reaching the listener's right and left ears. It is considered that, for a sound source located between left and right channels (phantom channel), the sound pressure difference and phase difference are provided between left and right channel signals L and R according to the direction of the sound source, and that the sense of direction of the sound source, i.e., the sense of location of a reproduced sound image for the phantom channel can be obtained by auditorily sensing the pressure difference, and phase difference of sounds radiated from the right and left speaker devices SR and SL. That is, it is believed that for a phantom sound source located at the front center, for example, a reproduced sound image is located at the front center provided that the left and right speaker systems simultaneously radiate acoustic energies which are same in magnitude and phase. However, a component L*l* of a left channel signal L from the left speaker device SL and a component R*l* of a right channel signal R from the right speaker device SR are applied to the left ear E*l* of the listener P. Likewise, a component Rr of the right channel signal R from the right speaker device SR and a component L*r* from the left speaker device SL are applied to right ear E*r* of the listener P. As will be evident from FIG. 1, distances SL-Er and SR-E*l* are greater than distances SL-E*l* and SR-E*r* in dependance upon the positional relation of the left and right speaker systems SL and SR. Accordingly, the left channel component L*r* to the listener's right ear E*r* and right channel component R*l* to the listener's left ear E*l* are somewhat time-delayed with respect to the left channel component L*l* to the listener's left ear E*l* and right channel component R*r* to the listener's right ear E*r*. The presense of such left and right channel components R*l* and L*r* offers a greater bar to the listener's sense of direction to a phantom sound image, imparing the location of the phantom sound image. This provides one decisive cause for an auditory difference between a real sound source and a phantom sound source. The sound image location is deteriorated due to the signal components E*l* and E*r* other than the channel signals L*l* and R*r* corresponding to the listener's left and right ears E*l* and E*r*, and such a deterioration prominently appears for a pulsive signal in particular due to the time delay as set out above. Where a pulsive signal to be located, for example, at the front center in the reproduction sound field as shown in FIG. 1 is provided, responses at the left and right ears E*l* and E*r* of the listener P are as shown in FIGS. 2A and 2B. Left and right channel signals L and R are radiated, in the same phase and amplitude, simultaneously from the left and right speaker devices SL and SR and applied as left and right channel components L*l* and R*r* to the left and right ears E*l* and E*r*, respectively. After lapse of a time $\Delta t$, leftand right channel components L*r* and R*l* are applied to the right and left ears E*r* and E*l* of the listener P, respectively. When, however, a pulsive sound is provided from an real sound source located at the front center, responses at the listener's left and right ears E*l* and E*r* are only such that components L*l'* and R*r'* are applied in the same phase and amplitude to the left and right ears E*l* and E*r* of the listener, respectively, as shown in FIGS. 3A and 3B. Since the components L*l* and R*r* are similar to the components L*l'* and R*r'* respectively, a difference in response between the phantom sound image and the actual sound image resides in that for the phantom sound source the components R*l* and L*r* are applied with a time delay $\Delta t$ after the left and right channel components L*l* and R*r* are applied to the listener's left and right ears E*l* and E*r*. Such a time delay is usually of the order of 200 $\mu$sec. It is said that a time difference with which the human being senses two pulsive signals as one signal through his ears is of the order of below about 60 $\mu$sec. Such time difference $\Delta t$ is to the extent of being sufficiently sensed by the ears of the human being, the responses shown in FIGS. 2A and 2B are substantially the same as in the case where similar sound sources are positioned in the respective positions of the left and right speaker devices SL and SR, or two real sound sources are positioned at the center front at different positions from the listener P. For the pulsive sound, therefore, the localization of the sound image becomes indefinite.

The components L*r* and R*l* have a time difference and phase difference with respect to the inherent left and right channel components L*l* and R*r*, making the rise time and phase relation of the inherent left and right channel signals indefinite and preventing the sensing of the direction of a sound image in dependence on the time difference and phase difference between the left and right channel signals.

Since musical sounds are comprised of a combination of continuous sounds and pulsive sounds, unless the deterioration of such a sound image location characteristic is prevented as far as possible, it is impossible to attain a good sound image reproduction.

In view of a recent reduction to practice of four-channel stereophonic systems it is desired to extend the location range of the sound image in a two-channel stereophonic reproduction system using a pair of speaker devices.

Summary of the Invention

An object of this invention is to provide a loudspeaker system for a stereophonic sound reproduction system, which is capable of attaining improved sound image location characteristics.

Another object of this invention is to provide a loudspeaker system for a stereophonic sound reproducing system, which is capable of extending a sound image location range.

A loudspeaker system according to this invention includes a main speaker and a sub-speaker both adapted to be driven by input signals and radiate acoustic energies corresponding to the input signals. The loudspeaker system is so adapted that the acoustic energy from the main speaker is different in phase from the acoustic energy from the sub-speaker and the acoustic energy from the sub-speaker is smaller in magnitude than the acoustic energy from the main speaker and is delayed with respect to the latter so as to reach a listener's ear later. An identical electrical signal is applied to the main speaker and sub-speaker but to sub-speaker is applied the electrical signal smaller in amplitude level than the main speaker by means of attenuator. Further, the electrical signal is applied to the voice coil of the sub-speaker through a phase shift circuit or in a phase opposite to the voice coil of the main speaker. In order for the acoustic energy from the sub-speaker to reach the listener's ear later than the acoustic energy from the main speaker, the electric signal may be applied through a delay circuit to the sub-speaker or the sub-speaker may be located more distant from the listener than the main speaker. As the sub-speaker use may be made of either a cone speaker or a horn speaker.

For a stereophonic sound reproduction by means of a pair of left and right speaker devices, for example, acoustic energy applied to the listener's left ear from the main speaker in the right speaker device can be attenuated by acoustic energy applied to the listener's left ear from the sub-speaker of the left speaker device, thereby providing an improved phantom sound image locatization and extending a stereophonic sound field over a wider range.

DETAILED DESCRIPTION OF THE INVENTION

Figure 4:
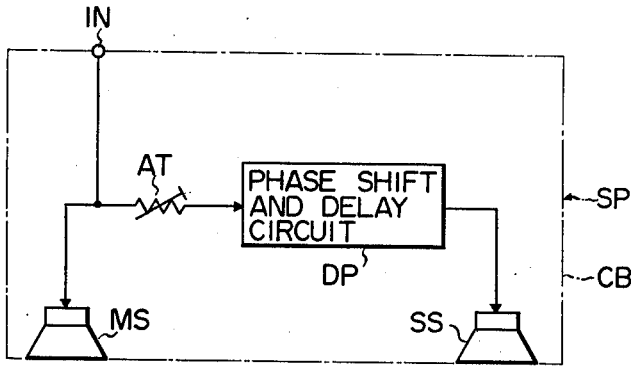
FIG. 4 schematically shows a loudspeaker system according to one embodiment of this invention.

FIG. 4 shows a speaker device SP, in particular a left channel speaker device, according to one embodiment of this invention. An audio frequency electric signal is fed through an input terminal IN at the rear of a cabinet CB to a main speaker MS located at the front-left of the cabinet CB, and through an attenuator AT and phase shift and delay circuit DP to a sub-speaker SS located at the front-right of the cabinet CB. In this speaker system, an electric signal phase-shifted (for example, about 180°) and delayed (for example about 0.2 ms), and having a smaller amplitude than, the electric signal to the main speaker MS is applied to the sub-speaker SS. In a right channel speaker device a sub-speaker SS is located at the left side of a main speaker MS.

Figure 1:
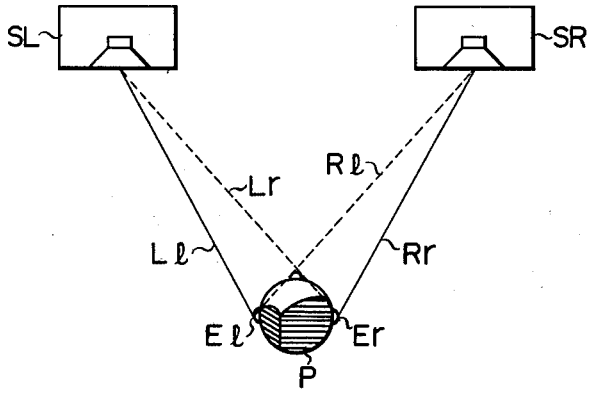
FIG. 1 PRIOR ART
FIG. 1 is a view for explaning a stereophonic sound reproduction system using a conventional loudspeaker devices.
Figure 2A:
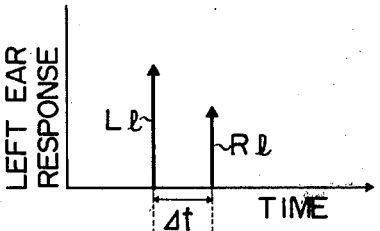
FIGS. 2A and 2B are views respectively showing responses of listener's left and right ears to a phantom sound source in the stereophonic sound reproduction system in FIG. 1.
Figure 2B:
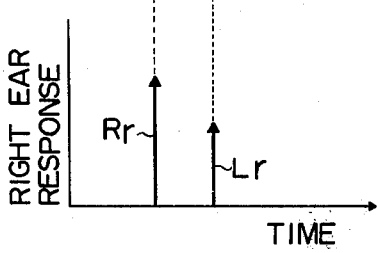
Figure 3A:
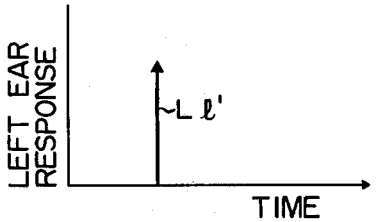
FIGS. 3A and 3B are views respectively showing responses of listener's left and right ears to a real sound source.
Figure 3B:
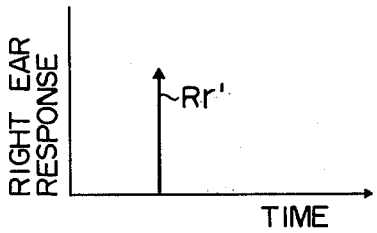
Figure 5:
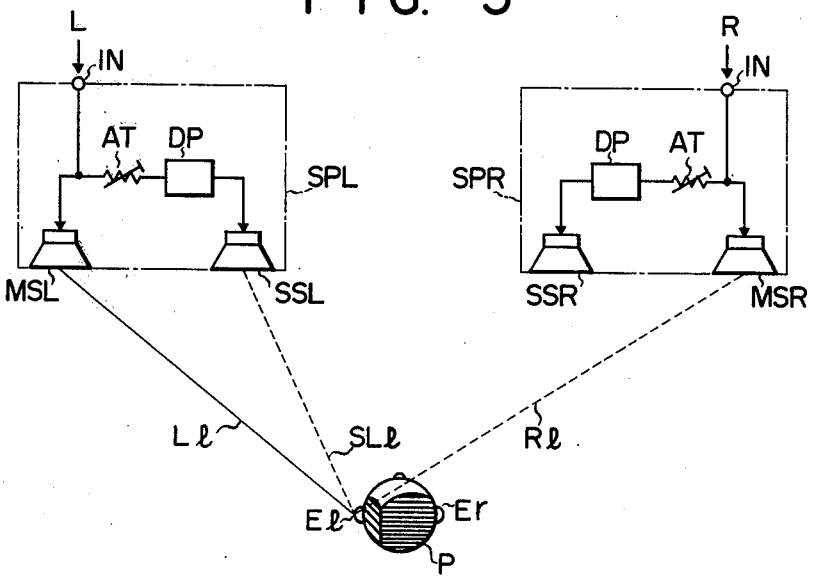
FIG. 5 is a view for explaining a stereophonic sound reproduction system using the loud speaker systems in FIG. 4.

A stereophonic reproduction system using such a pair of speaker systems will be explained by referring to FIG. 5. In the similar way as in FIG. 1 speaker systems SPL and SPR are located at equal distances from a listener P with the speaker system SPL at the front-left side and the speaker system SPR at the front-right side of a listening room.

Figure 6:
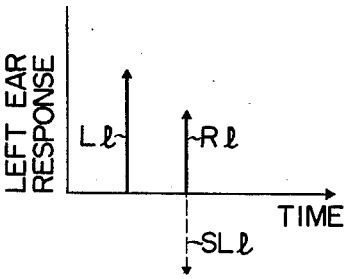
FIG. 6 is a view showing a response of the listener's left ear to a phantom sound source in the stereophonic sound reproduction system of FIG. 5.

To the left ear E*l* of the listener P are applied a left channel component L*l* emanated from the main speaker MSL of the left speaker device SPL and a right channel components R*l* emanated from the main speaker MSR of the right speaker device SPR. To the left ear E*l* of the listener P is also applied a left channel component SL*l* from the sub-speaker SSL of the left speaker SPL as obtained by subjecting the left channel signal L to level adjustment, phaseshifting and time delay. In general, a phantom channel signal is contained in both the left and right channels with a relatively small time difference and phase difference. When the left channel signal L is applied through an attenuator AT and phase shift and delay means DP to the sub-speaker SSL of the left speaker device SPL, the right channel component R*l* from the main speaker MSR of the right speaker device SPR can be effectively cancelled by the left channel component SL*l* from the sub-speaker SSL of the left speaker SPL. Now a pulsive sound from a center-front phantom sound source will be explained. In this case, in order to cancel the right channel component R*l* with delay of time $\Delta t$ after the left channel component L*l*, the component SL*l* is required to be applied to the left ear, simultaneously with the component R*l*, as an opposite phase signal with the same amplitude and waveform as shown in FIG. 6. Since the phantom sound signal is at the front-center, the left and right channel signals are exactly identical to each other and the component R*l* can be almost completely cancelled by the component SL*l* obtained from the left channel signal L through the attenuator AT and the delay means DP. However, the phantom sound source is not located at the front-center only and a sufficient result can be also obtained by simply decreasing the component R*l*. In consequence, a good result can be achieved over a wide range of phantom sound source by properly setting the amplitude level as well as the phase shift and delay time. The speaker system may be so designed as to enable to easily adjust either the amplitude or the phase shift and delay time, or both.

Although explanation has been made in connection with the signal applied to the listener's left ear, substantially the same holds true for a signal applied to the listener's right ear. Since the sub-speakers SSL and SSR are provided, in addition to the main speakers MSL and MSR, so as to decrease the components R*l* and L*r*, respectively, the listener P can listen to mainly the components L*l* and R*r* corresponding to the left and right signals L and R. As a result, the sense of location of phantom sound image can be more clearly provided to the listener P. Where, for example, only the left signal L is provided, sounds radiated from the main speaker MSL and sub-speaker SSL are weakened together at the right ear Er of the listener P, thus increasing a sound pressure difference between the right and left ears of the listener P and expanding the locating range of sound images, i.e., a stereophonic sound field.

Figure 7A:
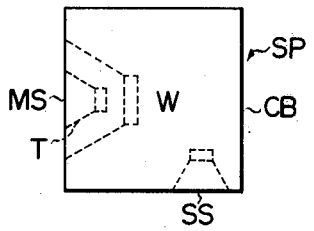
FIGS. 7A and 7B are an upper view and side view, respectively, showing a loudspeaker system according to another embodiment of this invention.
Figure 7B:
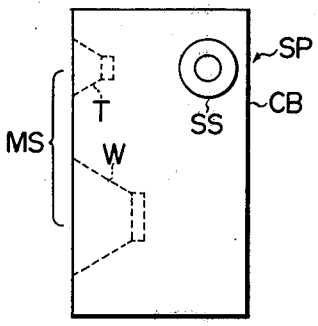

FIGS. 7A and 7B show a second embodiment of this invention applied to a so-called two-way speaker system. A low frequency speaker or woofer W and a high frequency speaker or tweeter T are mounted on the front of a cabinet CB and used as a main speaker MS. At the side of the cabinet CB closer to the listener P is provided a sub-speaker SS substantially similar to the high frequency speaker T which exerts a greater influence on the location of sound image.

Figure 8:
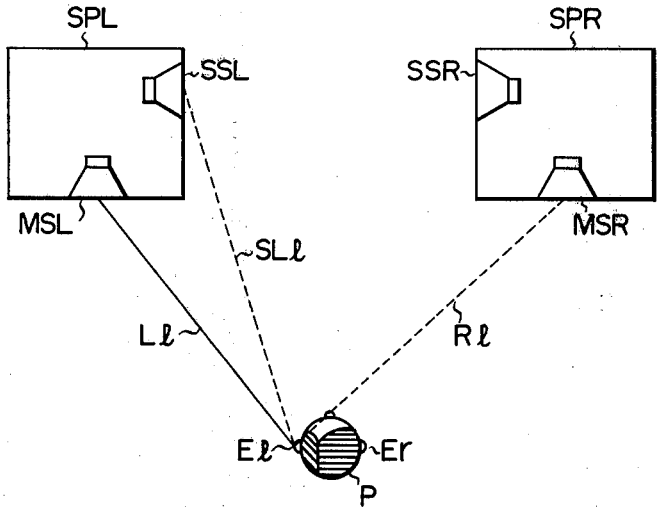
FIG. 8 is a stereophonic reproduction system using the loudspeaker systems in FIGS. 7A and 7B.
Figure 9:
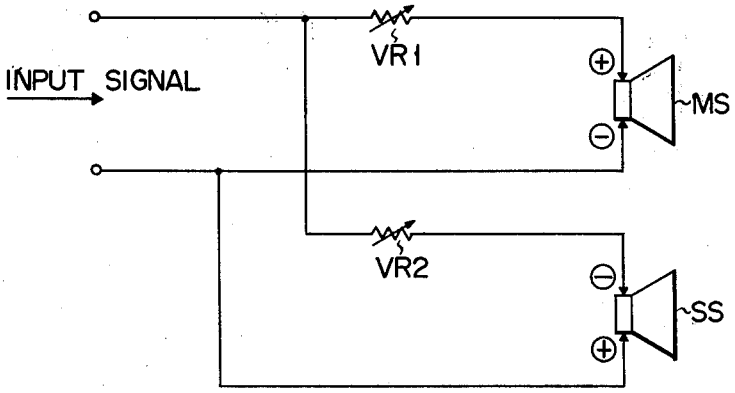
FIG. 9 is an illustrative wiring diagram for a main speaker and sub-speaker of the loud speaker system in FIGS. 7A and 7B.

When as shown in FIG. 8 the left and right speakers SPL and SPR are arranged at equal distances from the listener P with one at the left position and the other at the right position in the listening room, the sub-speaker SS is disposed more distant from the listener P than the mainspeaker MS. In this case, a component SL*l* from the sub-speaker SSL of the speaker device SPL can be delayed with respect to a left channel component L*l* from the main speaker MSL of the left speaker device SPL without using any delay circuit as shown in FIG. 4. The sound from the sub-speaker SSL may be opposite in phase to the sound from the main speaker MSL. As shown in FIG. 9, therefore, an audio frequency signal may be applied in opposite phase relation to the main speaker MS and sub-speaker SS through attenuators VR1 and VR2. The attenuators VR1 and VR2 are so adjusted that the input signal to the sub-speaker SS is considerably smaller in amplitude than the input signal to the main speaker MS. The right speaker device SPR is arranged similarly to the left speaker device SPL.

Figure 10:
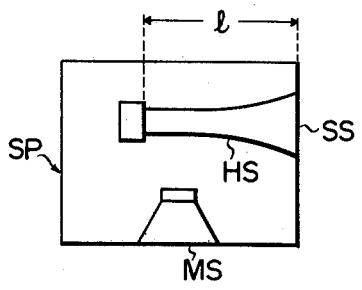
FIGS. 10 and 11, each, shows a loudspeaker system according to another embodiment of this invention.

FIG. 10 shows a third embodiment of this embodiment, in which as a sub-speaker use is made of a horn speaker HS instead of such a cone speaker in FIG. 7. In this embodiment a time, $l/c$ sec ($c$ is the speed of a sound), corresponding to a horn throat $l$ of the horn speaker HS is added as the time delay of a sound from the sub-speaker SS and, in consequence, a longer delay time can be obtained using a small speaker cabinet. Even in this embodiment, an input signal may be applied, as in the case of FIG. 9, to the main speaker MS and sub-speaker SS.

Figure 11:
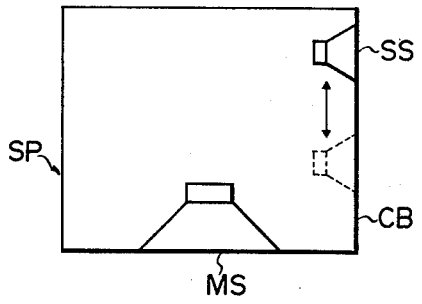

FIG. 11 shows a fourth embodiment of this invention in which a sub-speaker SS is so mounted on the side of a cabinet CB that it can be moved as indicated by an arrow along the inner side surface of the cabinet CB to permit adjustment of a time delay related to the sub-speaker SS. As a modification a plurality of sub-speakers may be mounted on the side surface of the speaker system so as to be switched from one to another.

Figure 12A:
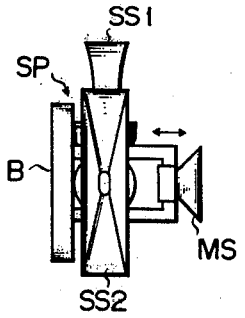
FIGS. 12A and 12B are a side view and front view, respectively, showing a loudspeaker system according to another embodiment of this invention.
Figure 12B:
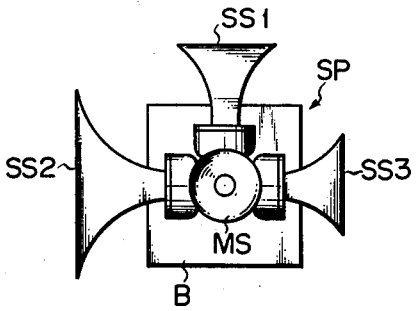
Figure 13:
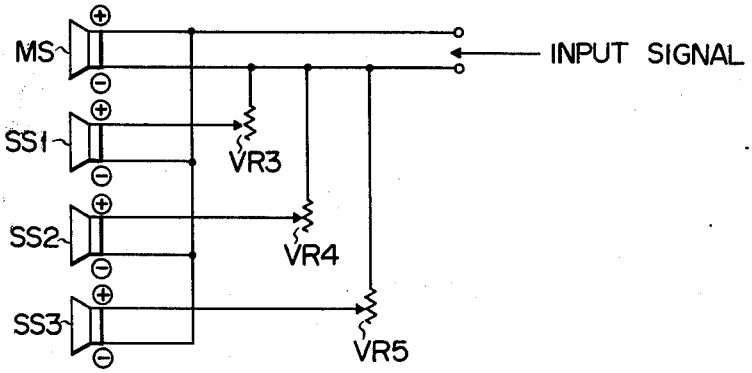
FIG. 13 is an illustrative wiring diagram for a main speaker and sub-speakers of the loudspeaker system in FIGS. 12A and 12B.

FIGS. 12A and 12B show a fifth embodiment of this invention. In this embodiment three horn sub-speakers SS1, SS2 and SS3 are arranged with respect to a cone main speaker directed to the front side with the sub-speaker SS1 directed to the upper side, the sub-speaker SS2 to the left side and the sub-speaker SS3 to the right side, and the main speaker MS can be moved, as indicated by an arrow in FIG. 12A, toward and away from a support board B. The sub-speakers SS1, SS2 and SS3 may have the same horn length or each may have a different horn length so as to obtain a different time delay. Input signals may be applied, as shown in FIG. 13, to the main speaker MS and sub-speakers SS1, SS2 and SS3. That is, the input signal is so applied through attenuators VR3, VR4 and VR5 to the sub-speakers SS1, SS2 and SS3 that it is smaller in amplitude than, and opposite in phase to, the signal applied to the main speaker MS. For example, the amplitude ratio of the signal to main speaker MS to the signal to each of the sub-speakers SS1, SS2 and SS3 may be selected to be about 1:0.3. A sound pressure ratio imparted by speakers to the listener will be different from the input signal amplitude ratio as set out above due to the directivity of each speaker. The fifth embodiment can provide an ambience effect since the speakers SS1, SS2 and SS3 are directed to the upper, left and right sides of a sound field, respectively. In this case, a sound reflection on the wall surface of a listening room can be expected through the side speaker, permitting a sound field to be extended outside the left and right speaker devices.

What we claim is:

1. A loudspeaker system for use in a stereophonic sound reproduction system for providing a stereophonic sound field using at least one pair of loudspeaker systems placed at equal distances from a listener in a listening room and receiving stereophonically related audio signals, each loudspeaker system comprising:

a main speaker responsive to application of a corresponding one of the stereophonic audio signals thereto to radiate an acoustic energy toward the listener; and a sub-speaker responsive to application of said corresponding one of the stereophonic audio signals thereto to radiate an acoustic energy which is out of phase with, and smaller in magnitude than the acoustic energy from said main speaker and reaches the listner's corresponding one ear later than the acoustic energy from said main speaker.

2. A loudspeaker system according to claim 1, in which said main speaker and said sub-speaker are disposed at the front of a loudspeaker cabinet with said sub-speaker disposed closer to the listener than said main speaker and including means for attenuating the amplitude level of the audio signal to said sub-speaker relative to the amplitude level of the audio signal to said main speaker and means for delaying the audio signal to said sub-speaker relative to the audio signal to said main speaker.

3. A loudspeaker system according to claim 1, in which said main speaker is disposed on the front surface of a loudspeaker cabinet and said sub-speaker is disposed on one side surface of the loudspeaker cabinet closer to the listener so that said sub-speaker is located more remote from the listener than said main speaker.

4. A loudspeaker system according to claim 3, in which said sub-speaker is movably mounted along the side surface of the cabinet.

5. A loudspeaker system according to claim 3, in which said sub-speaker includes a horn speaker.

6. A loudspeaker system according to claim 1, in which said main speaker and said sub-speaker are so connected that the audio signal is applied in opposite phase relation to said main speaker and said sub-speaker.

7. A loudspeaker system for use in a stereophonic sound reproduction system for providing a stereophonic sound field using at least one pair of loudspeaker systems placed substantially at equal distances from a listener in a listening room and receiving stereophonically related audio signals, each loudspeaker system comprising:

a main speaker responsive to application of the corresponding one of the stereophonic audio signals thereto for radiating an acoustic energy corresponding to the audio signal; and first, second and third sub-speakers responsive to application thereto of said corresponding one of the stereophonic audio signals which is smaller in amplitude than, and in an out-of-phase relation to the audio signal applied to said main speaker for radiating acoustic energies respectively in upper, left and right directions with respect to said main speaker.

8. A loudspeaker system according to claim 7, in which the audio signal applied to said main speaker is in opposite phase relation to those applied to said first, second and third sub-speakers.

9. A loudspeaker system according to claim 7, in which said first, second and third sub-speakers each include a horn speaker.

10. A loudspeaker system according to claim 7, in which said main speaker is disposed movably forward and backward with respect to said sub-speakers.

* * * * *